US005842592A

United States Patent [19]

Beck

[11] Patent Number: 5,842,592

[45] Date of Patent: Dec. 1, 1998

[54] TAMPER-EVIDENT SNAP ON CAP WITH TEAR LEVER

[75] Inventor: James M. Beck, Long Grove, Ill.

[73] Assignee: Creative Packaging Corp., Buffalo Grove, Ill.

[21] Appl. No.: 59,089

[22] Filed: Apr. 13, 1998

[51] Int. Cl.[6] ..... B65D 39/00

[52] U.S. Cl. ..... 215/253; 215/254

[58] Field of Search ..... 215/253, 254

[56] References Cited

U.S. PATENT DOCUMENTS

| | | | |
|---|---|---|---|
| 3,586,196 | 6/1971 | Barton . | |
| 3,684,124 | 8/1972 | Song . | |
| 4,354,610 | 10/1982 | Kessler et al. | 215/253 |
| 4,393,978 | 7/1983 | Kessler et al. | 215/253 |
| 4,494,663 | 1/1985 | Bertaud et al. . | |
| 4,522,308 | 6/1985 | Sullivan | 215/253 |
| 4,712,705 | 12/1987 | Fuehrer | 220/270 |
| 4,721,210 | 1/1988 | Lawrence et al. | 215/254 X |
| 4,941,592 | 7/1990 | Kitterman . | |
| 5,088,613 | 2/1992 | Dutt et al. . | |
| 5,104,008 | 4/1992 | Crisci . | |
| 5,346,100 | 9/1994 | Lay . | |
| 5,513,763 | 5/1996 | Adams et al. | 215/254 |
| 5,603,422 | 2/1997 | Herrmann . | |

*Primary Examiner*—Stephen K. Cronin
*Attorney, Agent, or Firm*—Silverman, Cass & Singer, Ltd.

[57] ABSTRACT

A tamper-evident cap retained on a container to seal the contents thereof. The cap includes a circumferential tamper band having an inwardly projecting annular flange to be engaged below an annular lip projecting from the mouth of the container. A tear lever is formed as part of the tamper band at a common hinge portion thereof. The tear lever includes a free edge disposed spaced from said hinge portion and connected to a free edge of said tamper band at two securement points only. The cap is removable from the container by pulling on said tear lever to separate same from the tamper band at the two securement points and pivoting the lever about the hinge to disengage the annular flange from the annular lip.

10 Claims, 3 Drawing Sheets

TAMPER-EVIDENT SNAP ON CAP WITH TEAR LEVER

BACKGROUND OF THE INVENTION

1. Field of the Invention

This invention relates generally to closures for re-sealable containers, and more particularly, to a tamper-evident snap on cap with tear lever for such containers.

2. Description of the Prior Art

It is known to provide snap on caps for containers to seal the contents thereof. Such caps commonly include a tear band or tab to permit separation of a depending flange portion of the cap from its main body part and thereby enable convenient removal of the cap from the container on which it initially is installed.

The use of a separable tear band or tab in conjunction with such caps to permit removal of the cap from its associated container also provides a tamper-evident feature for such caps. When the band or tab has been separated from the cap, there is a perceptible indication that the cap may have been removed from the container with resultant unauthorized tampering of the contents thereof.

The constructions of prior art caps have the disadvantage of not readily permitting re-installing of a snap on cap after it has been removed by separation of an associated tear band or tab. Although it is desirable to provide such a cap which can conveniently be re-installed on a container, such re-installing ideally does not conceal the tamper-evident feature which occurs after the cap has initially been removed.

Accordingly, it is desirable to provide such a tamper-evident snap on cap which is readily removable and re-installable on its associated container after it has initially been removed, yet maintains its tamper-evident feature even after such re-installation.

SUMMARY OF THE INVENTION

The invention provides a tamper-evident cap retained initially on the neck of an open mouth container by cooperative engagement between an outwardly projecting annular flange on the container neck and an inwardly projecting annular flange formed on a depending circumferential skirt of the cap. The circumferential skirt is formed as a tamper band and includes a tear lever which is permanently secured to the skirt at a common hinge portion thereof. The tear lever includes a free edge disposed spaced from said hinge portion and formed as a continuing portion of a free edge of said circumferential skirt. The free edge of the tear lever initially is connected to said circumferential skirt at two securement points only. The tear lever includes a circumferential wall portion extending between said two securement points and said common hinge portion of the skirt. The wall portion of the tear lever is disposed radially spaced from said skirt along oppositely facing free edges thereof.

The cap is removable from the container neck by a user who applies thumb and/or fingers to said free edges of the tear lever and pulls thereon to separate the lever from the skirt at said two securement points. Such separation permits the tear lever to be pivoted in a radial direction along the hinge common with the circumferential skirt. Pulling upwardly on the thus separated tear lever causes the annular flange of the cap to disengage from the annular flange on the container neck to permit removal of the cap.

When it is desired to re-install the cap on the container neck, the cap is re-positioned with its annular flange engaging below the annular flange of the container neck. The cap is then snapped back in place, but the tear lever remains disengaged from the tamper band because of its separation from the band at said two securement points. Therefore, although the cap may be reinstalled on the container, the tamper-evident feature is not defeated because the tear lever remains in its separated and visibly perceptible position.

DESCRIPTION OF THE PREFERRED EMBODIMENT

Figure 1:
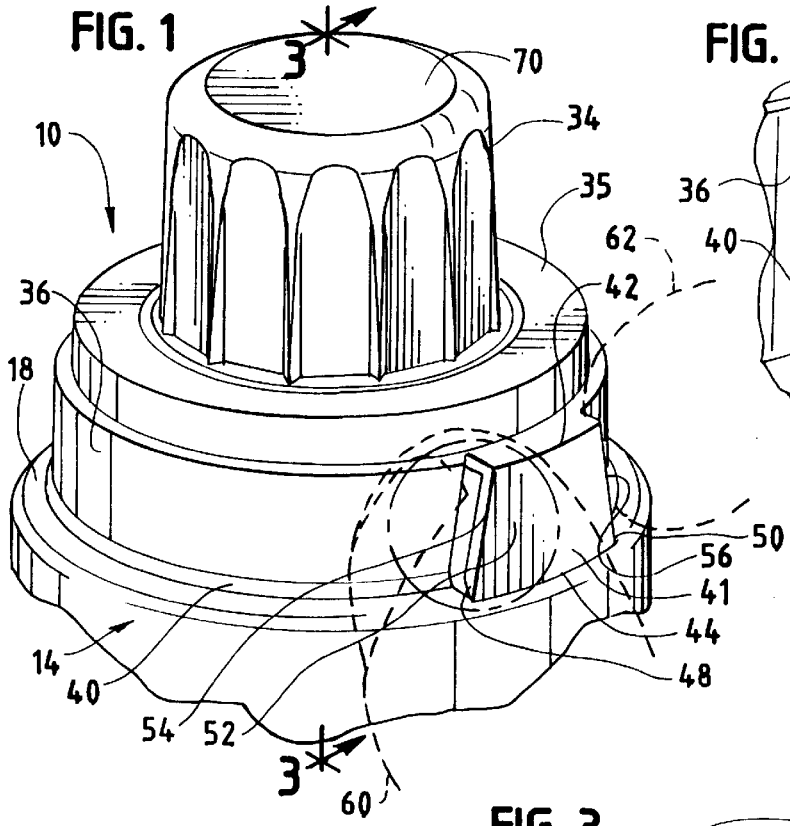
FIG. 1 is a perspective view of the tamper-evident snap on cap with tear lever of the invention, the same being shown installed on a container neck.
Figure 2:
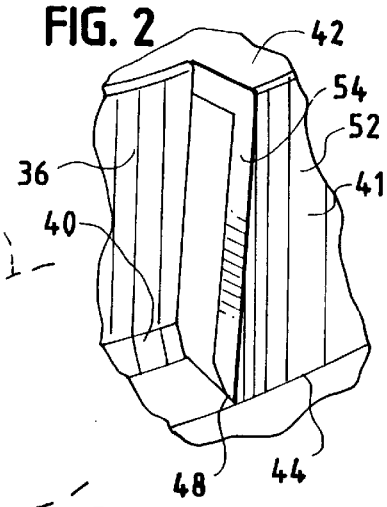
FIG. 2 is an enlarged sectional view taken through the circular section indicated as "FIG. 2" in FIG. 1.
Figure 3:
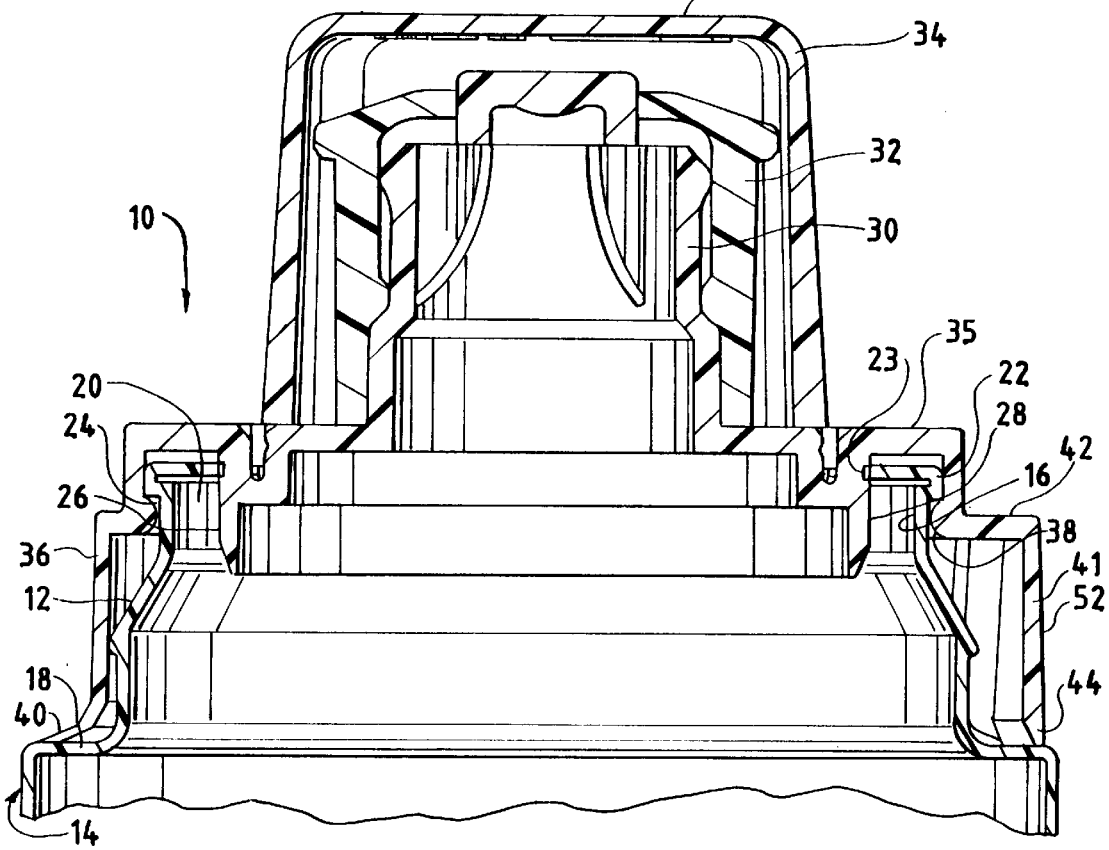
FIG. 3 is a sectional view taken along the line 3—3 of FIG. 1, in the direction indicated generally.

Referring to FIGS. 1–3, the snap on cap 10 of the invention is shown installed on the neck 12 of a container 14 having an open mouth 16 which is covered by the cap when the same is so installed. Neck 12 is joined to container 14 proximate an annular shoulder 18 which is of larger diameter than that of neck 12. Mouth 16 is formed at its terminal open end 20 with an annular protruding flange or lip 22 which extends about the entire external circumferential surface 24 of open end 20. The internal circumferential surface 23 of open end 20 is formed along a plane which is generally coextensive with the plane in which lip 22 is formed.

Cap 10 includes a depending plug 26 intended to be positioned within open mouth 16 with the external surface 28 of the plug engaged against internal circumferential surface 23 of end 20 to close the mouth 16 and prevent removal of the contents of container 14 when cap 10 is so installed. A post 30 with associated spout 32 and overcap 34 may be formed above plug 26 extending from tamper-evident base 35. The spout 32 and associated elements permits removal of the contents of the container in known manner without disengagement of the cap from the mouth 16. The construction of the post, spout and overcap is known and disclosed, for example, in co-pending U.S. application Ser. No. 08/726,511 filed Oct. 7, 1996, now U.S. Pat. No. , entitled "Tamper Evident Overcap," the disclosure of which hereby is incorporated herein by reference.

Tamper-evident base 35 is formed with a circumferentially extending, depending tamper band 36 which includes an interior projecting annular flange 38. When the cap 10 is installed on the neck 12 of container 14, flange 38 is engaged below lip 22 to maintain the cap in place. Installation of the cap 10 on the neck 12 is accomplished by snapping the cap in place so that flange 38 engages below lip 22.

Tamper band 36 terminates at its free edge 40 spaced from tamper evident base 35 and is intended to abut annular shoulder 18 to thereby completely cover neck 12 and prevent contamination thereof when cap 10 is installed on neck 12.

Tear lever 41 is formed as a portion of temper band 36 along a circumferential portion thereof. Tear lever 41 is permanently secured to band 36 along a common hinge portion 42 thereof positioned below base 35. The tear lever 41 has a free edge 44 disposed spaced from hinge portion 42 and formed as a continuing portion of free edge 40 of tamper band 36. The free edge 44 of tear lever 41 is connected to the tamper band 36 at two securement points 48, 50 only. Tear lever 41 includes an external circumferential wall portion 52 extending between the free edge 44 with securement points 48, 50 and the hinge portion 42 common with the tamper band 36. The wall portion 52 is disposed radially spaced outwardly from the tamper band 36 along oppositely facing free edges 54, 56 thereof.

Figure 4:
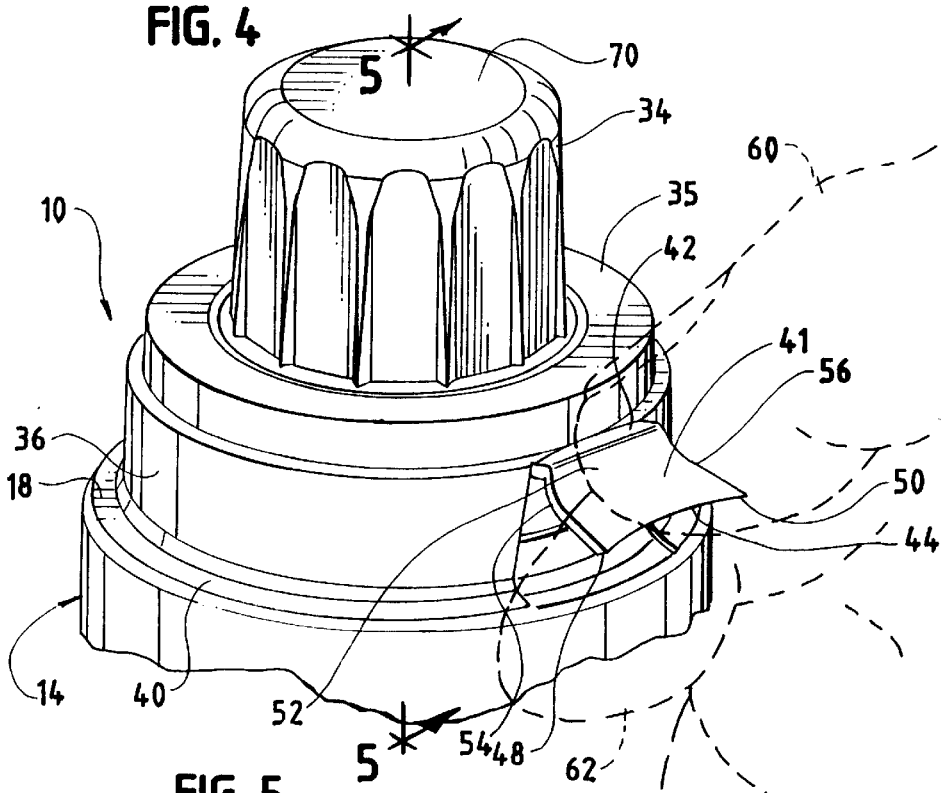
FIG. 4 is a perspective view similar to that of FIG. 1, but illustrating the manner of lifting the tear lever by a user's thumb and/or fingers.
Figure 5:
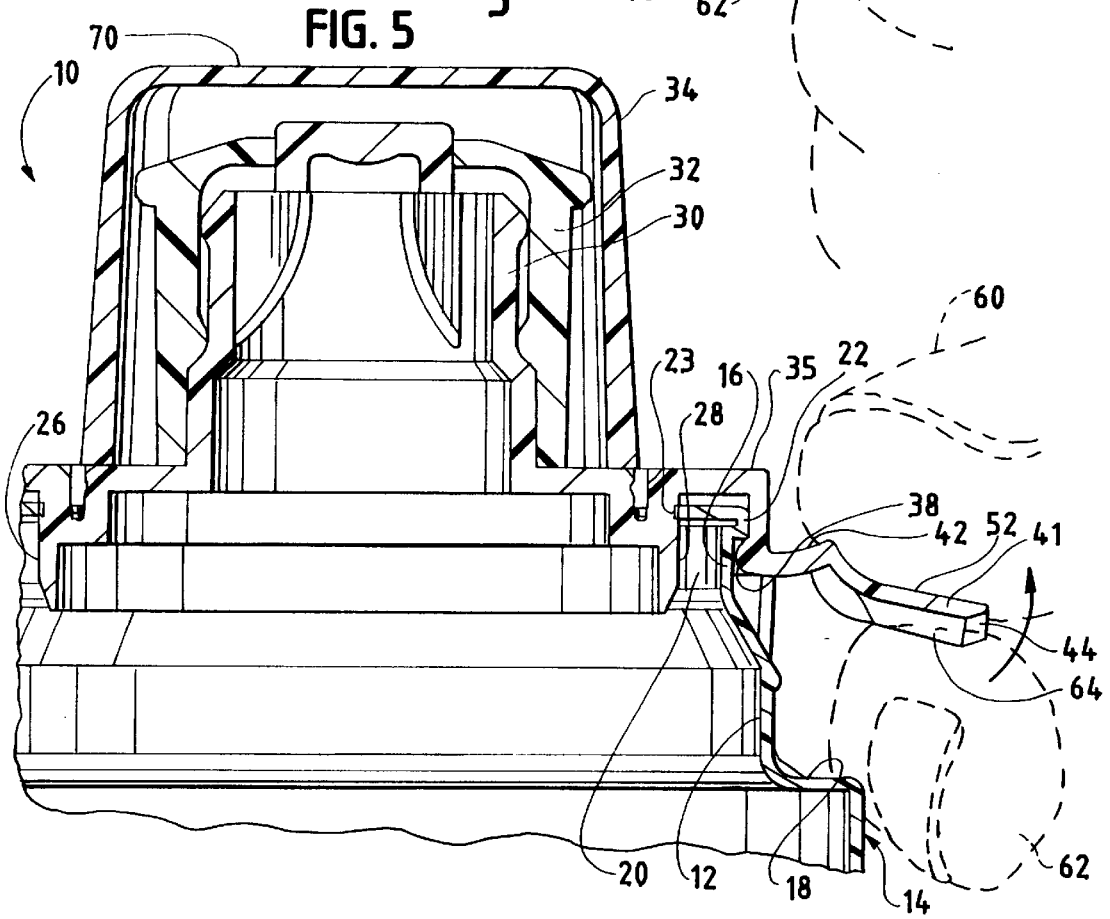
FIG. 5 is a sectional view taken along the line 5—5 of FIG. 4, in the direction indicated generally.

When it is desired to remove cap 10 from container 14, the user initially grasps oppositely facing free edges 54, 56 of tear lever 41 with thumb and/or fingers 60, 62 as shown in FIG. 1, and pulls in a generally radial direction upon the tear lever to separate same from tamper band 36 at the securement points 48, 50. Separation of the tear lever in this manner at the securement points enables the free edge 44 to move away from its initial position abutting annular shoulder 18, as seen in FIGS. 1–3, to an extended position spaced from the annular shoulder, as seen in FIGS. 4 and 5.

Figure 6:
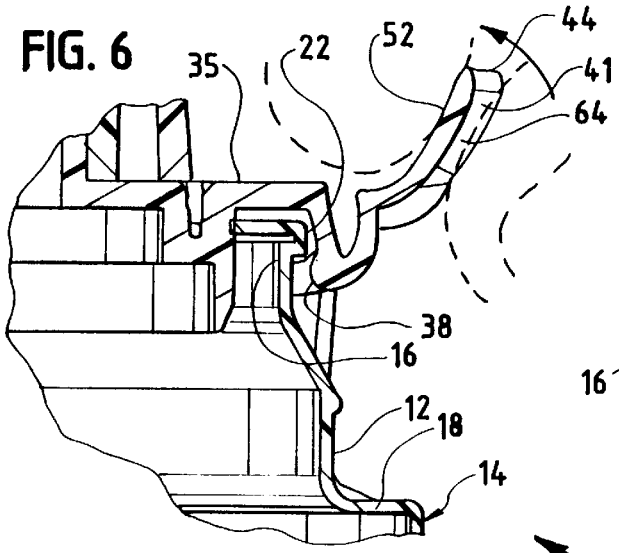
FIG. 6 is an enlarged fragmentary sectional view of the tear lever shown in FIG. 5, illustrating the tear lever moved toward the cap removal position.
Figure 7:
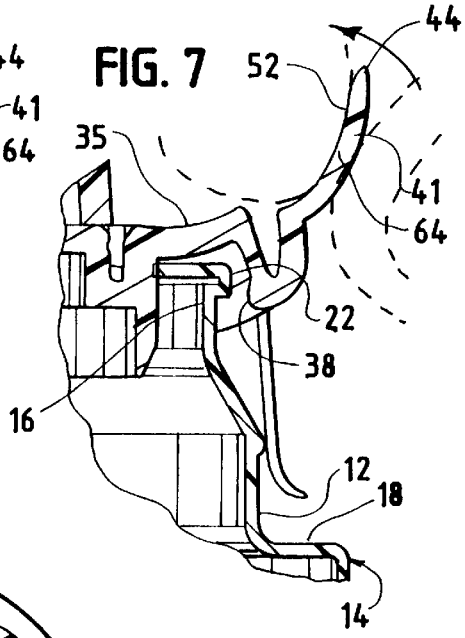
FIG. 7 is a view similar to that of FIG. 6, showing the tear lever moved further toward the cap removal position.
Figure 8:
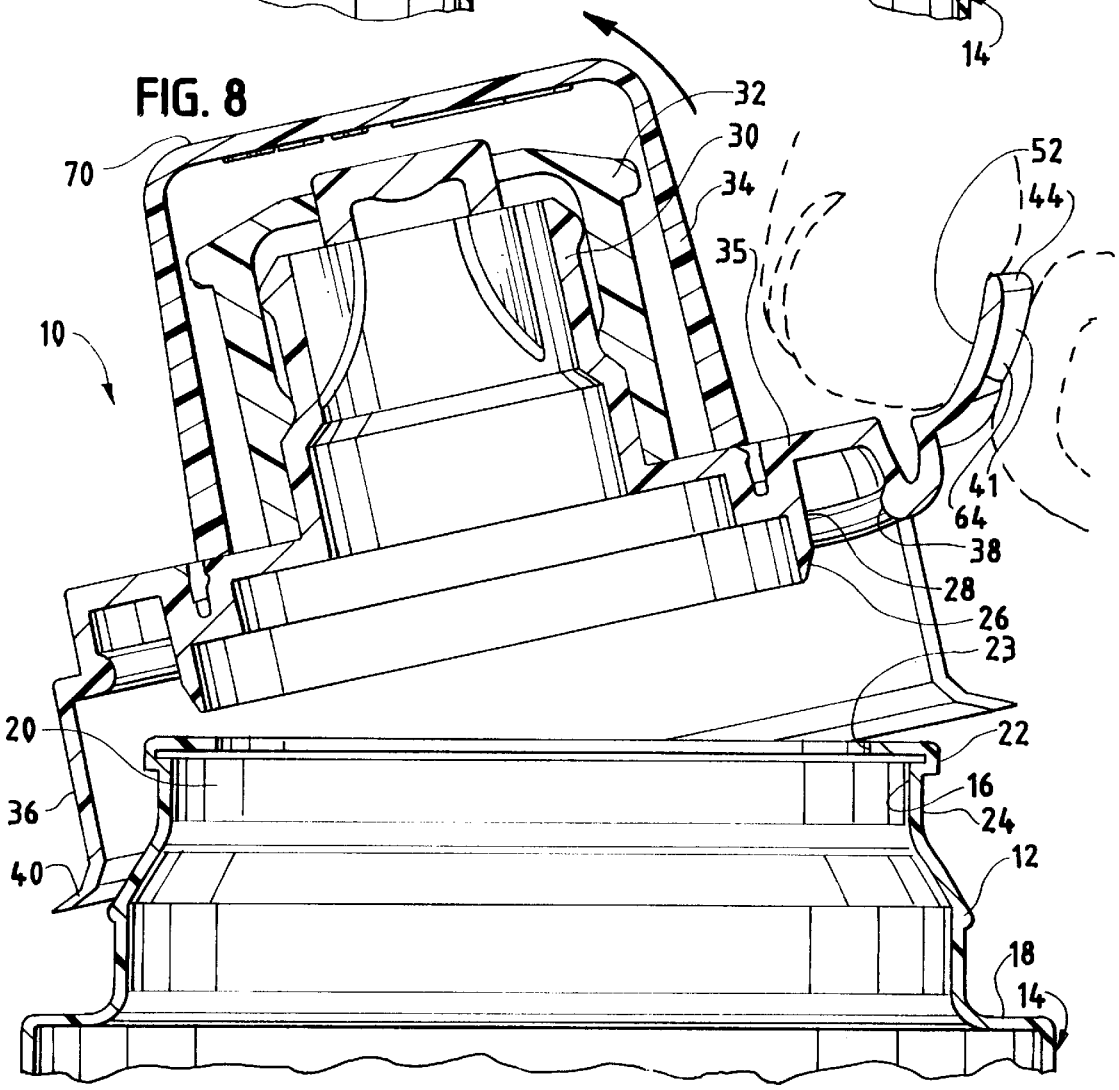
FIG. 8 is a view similar to that of FIG. 5, showing the cap separated from its associated container neck.

After the tear lever has been so separated at securement points 48, 50, the user applies thumb and/or fingers 60, 62 to the external wall portion 52 and internal wall portion 64 thereof (FIG. 4 and 5) and pivots the lever upwardly in a radial direction along the hinge 42 common with tamper band 36. Pulling upwardly on the thus separated tear lever causes the annular flange 38 on the tamper band to disengage from below the lip 22 on container mouth 16, as seen in progressive stages in FIGS. 5, 6 and 7. When flange 38 has been completely separated from lip 22, as seen in FIG. 8, the cap 10 is removed from container 14 by pulling upwardly on lever 41 to disengage plug 26 from mouth 16.

The procedure is reversed when it is desired to re-install cap 10 on container 14. Plug 26 is re-positioned in mouth 16 with annular flange 38 resting on lip 22. The user then asserts a force upon the top 70 of cap 10 or overcap 34 to snap flange 38 over lip 22 into engagement position below the lip, as seen in FIG. 5. When so re-installed, free edge 44 of tear lever 41 remains disengaged from tamper band 36 because of its permanent separation from the band at securement points 48, 50. Such permanent disengagement of the tear lever functions as a tamper-evident feature of the cap.

Minor variations in the structure and other variations in the arrangement and size of the various parts may occur to those skilled in the art without departing from the spirit or circumventing the scope of the invention as set forth in the appended claims.

I claim:

1. A tamper-evident cap to close a container having a neck opening to a mouth, the mouth having an annular protruding lip extending about an external surface thereof, said cap comprising, a tamper-evident base to be positioned over said mouth, a circumferentially extending tamper band depending from said base and having a free edge spaced from said base, said tamper band including an interior projecting annular flange adapted to be engaged below said lip to maintain the cap upon said container to close said mouth, a tear lever formed as a portion of said tamper band along a circumferential portion thereof, said tear lever being permanently secured to said band along a common hinge portion thereof positioned below said base, said tear lever having a free edge spaced from said hinge portion and formed as a continuing portion of said free edge of the tamper band, said free edge of the tear lever being connected to the tamper band at two securement points only, said tear lever including an external circumferential wall extending between the free edge of the tear lever and the hinge portion, said wall having oppositely facing free edges, said wall being disposed radially spaced outwardly from the tamper band along said free edges.

2. A cap as claimed in claim 1 in which the two securement points are separable upon pulling upon said tear lever by asserting a force applied to said free edges to pull the tear lever in a radial direction away from the container.

3. A cap as claimed in claim 2 in which separation of the tear lever at said two securement points causes the tear lever to be permanently separated from said tamper band along the respective free edges thereof.

4. A cap as claimed in claim 2 in which the tear lever is movable in a radial upward direction after separation of said two securement points, and movement of said tear lever in said radial upward direction causes said interior projecting annular flange to disengage from said lip, whereby said cap is removable from said container.

5. A cap as claimed in claim 4 including a plug depending from said tamper-evident base to be engaged within said mouth.

6. In combination, a container having a neck and a mouth and a cap to close said container mouth, the mouth including an annular protruding lip extending about an external surface thereof, said cap comprising, a tamper-evident base to be positioned over said mouth, a circumferentially extending tamper band depending from said base and having a free edge spaced from said base, said tamper band including an interior projecting annular flange adapted to be engaged below said lip to maintain the cap upon said container to close said mouth, a tear lever formed as a portion of said tamper band along a circumferential portion thereof, said tear lever being permanently secured to said band along a common hinge portion thereof positioned below said base, said tear lever having a free edge spaced from said hinge portion and formed as a continuing portion of said free edge of the tamper band, said free edge of the tear lever being connected to the tamper band at two securement points only, said tear lever including an external circumferential wall extending between the free edge of the tear lever and the hinge portion, said wall having oppositely facing free edges, said wall being disposed radially spaced outwardly from the tamper band along said free edges.

7. A cap as claimed in claim 6 in which the two securement points are separable upon pulling upon said tear lever by asserting a force applied to said free edges to pull the tear lever in a radial direction away from the container.

8. A cap as claimed in claim 7 in which separation of the tear lever at said two securement points causes the tear lever to be permanently separated from said tamper band along the respective free edges thereof.

9. A cap as claimed in claim 7 in which the tear lever is movable in a radial upward direction after separation of said two securement points, and movement of said tear lever in said radial upward direction causes said interior projecting annular flange to disengage from said lip, whereby said cap is removable from said container.

10. A cap as claimed in claim 9 including a plug depending from said tamper-evident base to be engaged within said mouth.

* * * * *